United States Patent [19]

Berghash et al.

[11] Patent Number: 4,832,653

[45] Date of Patent: May 23, 1989

[54] TOY MUSICAL INSTRUMENT

[75] Inventors: Robert D. Berghash, Buffalo; Dan A. Jachimowicz, Elba, both of N.Y.

[73] Assignee: Brimms Inc., Tonawanda, N.Y.

[21] Appl. No.: 882,478

[22] Filed: Jul. 7, 1986

[51] Int. Cl.[4] ..... A63H 5/00

[52] U.S. Cl. ..... 446/416; 446/207; 446/408

[58] Field of Search ..... 446/202, 207, 408, 415, 446/416, 419; 84/330, 375; 403/349

[56] References Cited

U.S. PATENT DOCUMENTS

| | | | |
|---|---|---|---|
| 700,986 | 5/1902 | Smith | 446/416 |
| 724,256 | 3/1903 | Brown | 215/357 |
| 788,158 | 4/1905 | Lazareff | 215/357 |
| 788,495 | 4/1905 | Sawin | 215/262 |
| 826,226 | 7/1906 | Burton | 215/357 |
| 900,110 | 10/1908 | Matthias | 215/357 |
| 1,327,454 | 1/1920 | Wieland | 413/24 |
| 1,354,959 | 10/1920 | Debs | 446/416 |
| 1,415,908 | 5/1922 | Tofting | 215/231 |
| 2,700,316 | 1/1955 | Grodon et al. | 84/330 |
| 3,256,636 | 6/1966 | Green | 446/408 |
| 3,393,816 | 7/1968 | Grimm | 215/223 |
| 3,627,160 | 12/1971 | Horvath | 215/223 |
| 3,883,982 | 5/1972 | McClary | 446/416 |
| 3,901,401 | 8/1975 | Lynn et al. | 215/223 |

FOREIGN PATENT DOCUMENTS

| | | | |
|---|---|---|---|
| 236778 | 7/1925 | United Kingdom | 446/416 |

*Primary Examiner*—Mickey Yu
*Assistant Examiner*—Charles H. Harris
*Attorney, Agent, or Firm*—Christel, Bean & Linihan

[57] ABSTRACT

A toy musical instrument of the type commonly known as a kazoo having an open-ended turret section, a resonating membrane positioned within the turret section and a retainer member for installation within the turret section and for releasably securing the membrane within the turret section utilizes a turret section having a plurality of protuberences and a retainer member defining an embossment which cooperates with the protuberences to secure the retainer member in a snap-fit relationship with the turret section when the retainer has been inserted a preselected distance through the open end of the turret section. The embossment and the protuberences are so shaped to permit the retainer and the turret section to be disassembled from snap-fit relationship only if the retainer body is positioned in a preselected rotational orientation relative to the turret section.

7 Claims, 2 Drawing Sheets

Fig. 1.
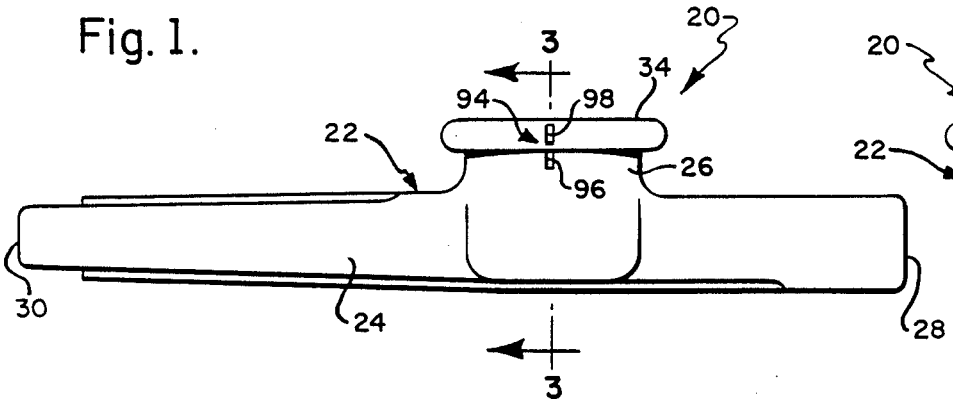
Fig. 2.
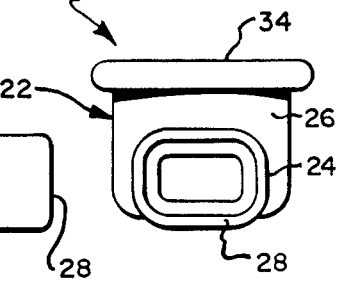
Fig. 3.
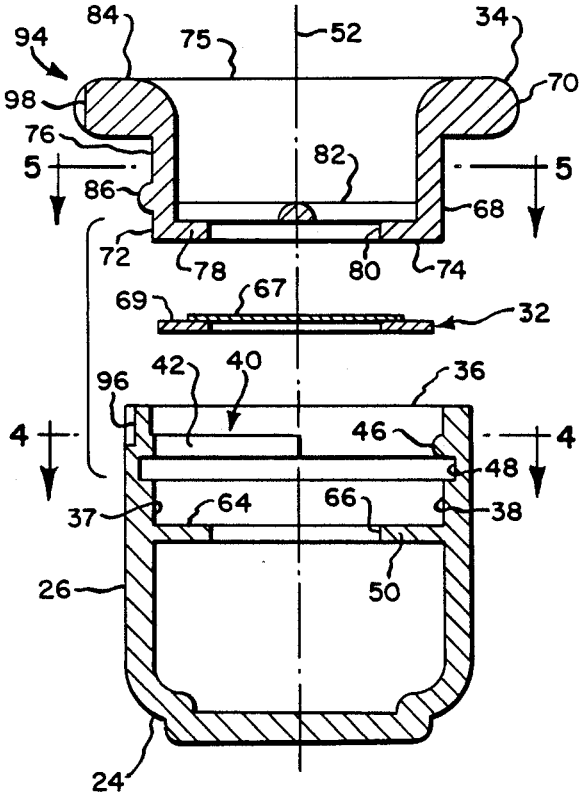
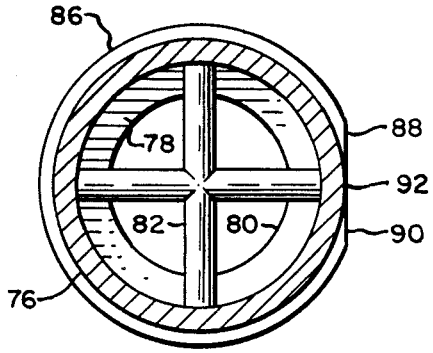
Fig. 5.
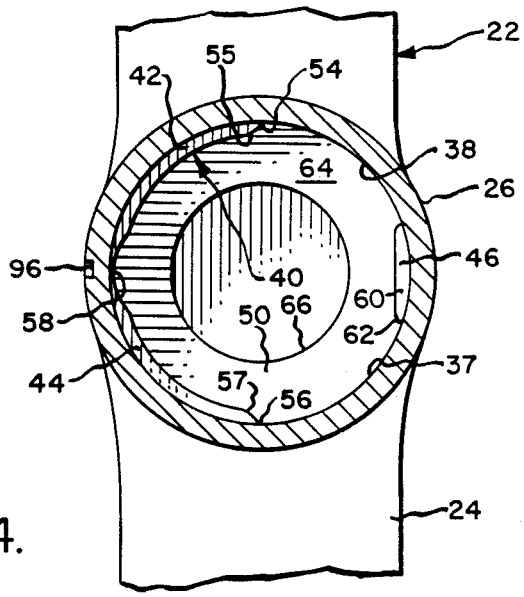
Fig. 4.

TOY MUSICAL INSTRUMENT

BACKGROUND OF THE INVENTION

This invention relates generally to toys and relates more particularly to improvements in toy musical instruments.

The type of toy musical instrument with which this invention is concerned commonly includes a hollow, elongated tubular section through which air is directed when the toy is operated and a hollow, open-ended turret section joined to the tubular section so that the hollow interiors of the turret and tubular sections are in communication with one another and so that the open end of the turret section opens to one side of the tubular section. The instrument further includes a resonating membrane operatively positioned within the turret section and a retainer attached to the turret section member for releasably securing the membrane within the turret section. By removing the retainer, access is provided to the membrane for purposes of cleaning or replacement. An instrument of the aforedescribed type is commonly referred to as a kazoo, and an example of such an instrument is shown and described in U.S. Pat. 1,354,959.

For purposes of releasably securing the membrane within the turret section, the turret section and retainer are commonly adapted to cooperate with one another in an easy-to-assemble arrangement permitting the membrane to be initially positioned within the turret section and the retainer subsequently secured therein to thereby sandwich the membrane between opposing surfaces of the turret section and retainer. Such an arrangement can be a bayonet-type arrangement, such as is shown and described in the referenced patent wherein the retainer defines outwardly-directed projections and the inner surface of the turret section defines cam-like bayonet grooves for guidably accepting the projections when the retainer is installed within the turret section. In order to install the retainer, the retainer is inserted through the open end of the turret section while the projections are received by openings in the bayonet grooves and the retainer is subsequently rotated in a predetermined rotational direction relative to the turret section from an initial position at which the retainer is loosely fitted within the turret section to another position at which the retainer is positioned in a relatively snug-fitting relationship with the turret section. In order to remove the retainer the retainer, is simply rotated relative to the turret section in the direction opposite the direction rotated during installation to section aforesaid initial position and withdrawn through the open end of the section turret section.

Inasmuch as children play with instruments of the aforedescribed type, it is desirable to render such instruments safe for use by children. To this end, it is desirable to provide such an instrument with a membrane-securing arrangement which cannot be easily disassembled by children who may subsequently injure themselves with the retainer by careless handling or by placing it within the mouth.

Accordingly, it is an object of the present invention to provide a new and improved toy musical instrument of the aforedescribed type having a membrane-securing arrangement which cannot be easily disassembled by a child.

Another object of the present invention is to provide such an instrument which is economical to manufacture and effective in operation.

SUMMARY OF THE INVENTION

The invention resides in a new and improved musical instrument toy having an improved membrane-securing arrangement.

The instrument of the invention includes means defining a hollow, elongated tubular section through which air is directed when the instrument is operated and a hollow turret section having an open circular end and an inner surface extending from the open end so as to define an elongated interior cavity. The turret section is joined to the tubular section so that the hollow interiors of the turret and tubular sections are in communication with one another and the open end of the turret section opens to one side of the tubular section. The inner surface of the turret section includes means defining a plurality of radially inwardly-directed protuberances and a radially inwardly-directed annular flange. The protuberances are spaced from the open end of the tubular section and arranged in common radial plane and the inwardly-directed annular flange is spaced from the protuberances and positioned to one side thereof opposite the open end of the turret section.

The instrument further includes means defining a resonating membrane operatively positioned within the turret section so as to span the turret section flange and means defining a retainer for releasably securing the membrane within the turret section. The retainer includes an elongated body having two opposite end portions, one of which defines a circular membrane-facing end an an outer surface extending from the membrane-facing end. The outer surface of the retainer end portion includes means defining a radially outwardly-directed flange arranged in a radial plane, and the retainer body flange and the protuberances are cooperable with one another to permit the retainer body flange to snap over the protuberances when the membrane-facing end is inserted a predetermined distance through the open end so that the retainer body is secured in a snap-fit relationship with the turret section and the membrane is held between the membrane-facing end and the turret flange.

BRIEF DESCRIPTION OF THE DRAWING FIGURES

FIG. 1 is a side elevation view of an embodiment of a toy musical instrument in accordance with the present invention.

FIG. 2 is an end elevation view of the FIG. 1 embodiment as seen from the right in FIG. 1.

FIG. 3 is an exploded cross-sectional view taken about on line 3—3 in FIG. 1.

FIG. 4 is a cross-sectional view taken about on line 4—4 of FIG. 3.

FIG. 5 is a cross-sectional view taken about on line 5—5 of FIG. 3.

DETAILED DESCRIPTION OF THE ILLUSTRATED EMBODIMENT

Figure 6:
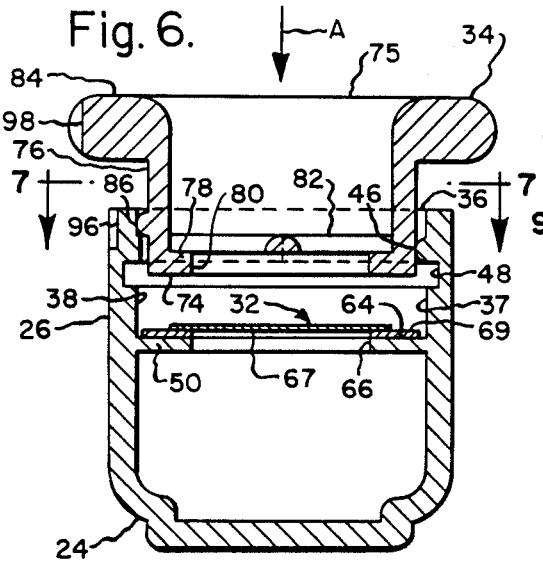
FIG. 6 is a view similar to that of FIG. 3 illustrating a relationship between the retainer and turret section prior to being moved relative to one another in snap-fitting relationship.

Turning now to the drawings in greater detail and considering first FIGS. 1 and 2, there is shown an embodiment of a toy musical instrument, generally indicated 20, in accordance with the present invention. The instrument 20 includes body means, generally indicated 22, defining a hollow elongated tubular section 24 and a hollow necklike turret section 26. The tubular section 24 has a mouthpiece end 28 and an opposite air-escape end 30 and as best shown in FIG. 2 is somewhat rectangular in cross-section. With reference to FIG. 3, the instrument 20 further includes means defining a resonating membrane 32 operatively positioned within the turret section 26 and means defining a retainer 34 for releasably securing the membrane 32 within the turret section 26. When the instrument 10 is in use, sounds introduced into the mouthpiece end 14 are magnified by a vibrating action of the membrane 20 in a manner well known in the art. As will be explained in greater detail hereinafter, the retainer 34 and the turret section 26 are adapted to be attached to one another for the purpose of holding the membrane 32 in place and are adapted to be detached from one another to provide access to the membrane 32.

With reference to FIGS. 1–3, the tubular and turret sections 24 and 26 are integrally joined together as a single unit. To this end, the body means 22 can be molded from a polypropylene plastic or another resiliently yieldable material. As best shown in FIG. 3, the turret section 26 has an open end 36 arranged in a plane and is so joined to the tubular section 24 that the hollow interiors of the tubular and turret sections 24 and 26 are in communication with one another and the open end 36 opens to one side, or the upper side as shown in FIGS. 1–3, of the tubular section 24.

With reference to FIGS. 3 and 4, the turret section 26 defines a generally cylindrically-shaped inner surface 38 extending from the open end 36 so as to define an elongated cavity 37. In accordance with the present invention, the inner surface 38 includes protuberance means 40 defining a plurality of radially inwardly-directed projections or protuberances 42,44,46, as shown, an annular groove 48, and a radially inwardly-directed flange 50. As best shown in FIG. 4, the protuberances 42,44 and 46 are generally arranged in a common radial plane, or a plane oriented generally parallel to the plane of the open end 36 and perpendicular to the longitudinal axis, indicated 52, of the turret section cavity 37 and inner surface 38, and are spaced a relatively short distance from the open end 36. As exemplifed by the protuberance 46 illustrated in FIG. 3, each protuberances 42,44 or 46 is semicircular in cross-sectional shape.

As viewed in FIG. 4, two protuberances 42 and 44 are arcuate in shape and collectively extend around the inner surface 38 from a first point, indicated 54, located on one side of the inner surface 38 to a second point indicated 56, located on the other side of the surface 38 generally diametrically opposed to the first point 54. Furthermore and as shown in FIG. 4, the portions of the protuberances 42 and 44 which terminate at points 54 or 56 defined tapered edges 55 or 57, respectively. Defined so as to be centrally positioned between the protuberances 42 and 44 is an arcuately-shaped gap 58. The protuberance 46 is provided by a lug or detent 60 having a generally straight edge 62 as shown in FIG. 4 and is located along the inner surface 38 so as to be diametrically opposed to the paired arcuate protuberances 42 and 44 and to the centrally-positioned gap 58.

With reference again to FIG. 3, the annular groove 48 is defined adjacent the protuberances means 40 and to one side of the radial plane thereof opposite the open end 36. The groove 48 includes walls which meet in the manner shown in FIG. 3 to provide the groove 48 with a relatively shallow channel-like cross section. The annular flange 50 is spaced from the groove 48 and positioned to one side thereof opposite the open end 36. The flange 50 defines a central opening 66 and, for a reason which will be apparent hereinafter defines a side surface, indicated 64 and positioned on the upper surface side as shown in FIG. 3, oriented generally perpendicular to the longitudinal axis 52 and which faces generally out of the open end 36.

The resonating membrane 32 includes a ringlike frame 69 and a piece of membrane material 67 extending across and attached to the frame 69 so as to span or cover the opening in the frame 69. The frame 69 is generally platen in shape, constructed of a relatively rigid material such as a hard plastic or cardboard, and is of such size to be inserted through the open end 36 so as to engagably overlie the side surface 64 of the flange 50. The membrane material 67 can be comprised of a silicone plastic material or other suitable resonating material and is suitably fixed, such as with glue, to the frame 69.

With reference to FIGS. 3 and 5, the retainer 34 is in the form of a hollow elongated body 75 having an outer surface 76 and two opposite end portions 68 and 70. The material comprising the body of the retainer 34 can be a polypropylene plastic or another resiliently yieldable material. One end portion 68 of the retainer 34 has a generally cylindrically shaped outer surface 72 and defines a membrane-facing end 74 adapted to be inserted through the open end 26 of the turret section 34 in a manner hereinafter described for operative engagement with the frame 69 of the membrane 32. The end portion 68 further defines a radially inwardly-directed flange 78 defining a central opening 80 and positioned adjacent the retainer end 74. The other end portion 70 defines a generally radially-outwardly directed annular flange portion 84 and, as shown in FIG. 3, has generally rounded outer edges.

The retainer 34 further includes a cruciform member 82 positioned in engagement with one side of the flange 78 opposite the retainer end 74 and fixedly attached thereto. Although the retainer body 75 and the cruciform member 82 are described herein as two separate pieces which are joined together to form a unitary assembly, it will be understood that the retainer body 75 and cruciform member 82 can be integrally formed, such as by a molding process, as a single unit.

In accordance with the present invention and with reference to FIGS. 3 and 5, the outer surface 72 of the retainer end portion 68 includes means defining a retainer flange 86, as shown. The retainer flange 86 is in the form of a radially outwardly projecting detent which, as best shown in FIG. 3, is semicircular in cross section. As best shown in FIG. 5, the retainer flange 86 extends for a substantial distance around the retainer end portion 68 and terminates as two ends or edges 88 and 90 so as to define a gap flat or cut-away 92 in the retainer flange 86. More specifically, the ends 88 and 90 of the retainer flange 86 terminate in a plane oriented tangentially to the cylindrical portion of the outer surface 72 so that the cut-away 92 is generally straight-edged as viewed in FIG. 5. For a reason which will be apparent hereinafter, the retainer end 74 is slightly smaller in diameter than the open end 36 of the turret section 26 and the retainer flange cut-away 92 accomodates the turret section cut-away 92 or permits the protuberancs 46 to move past the protubances 46, when the retainer 34 is inserted into the open end 36 in an axial direction. The flange 86 is of such size to be received by the annular groove 48 when the retainer 34 is operatively received by the turret section 26.

Figure 8:
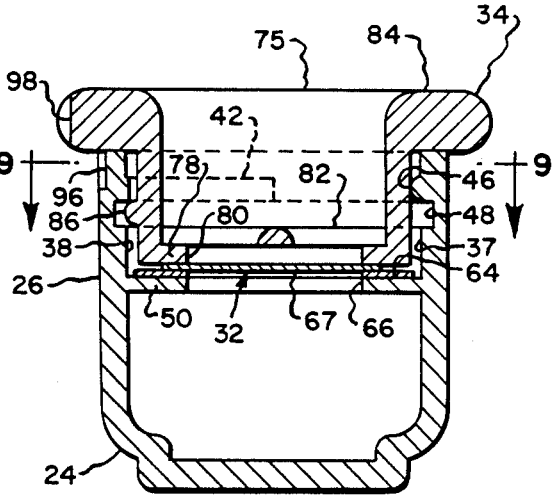
FIG. 8 is a view similar to that of FIG. 6 illustrating the relationship between the retainer and the turret section when positioned in operative, snap-fitting relationship.
Figure 7:
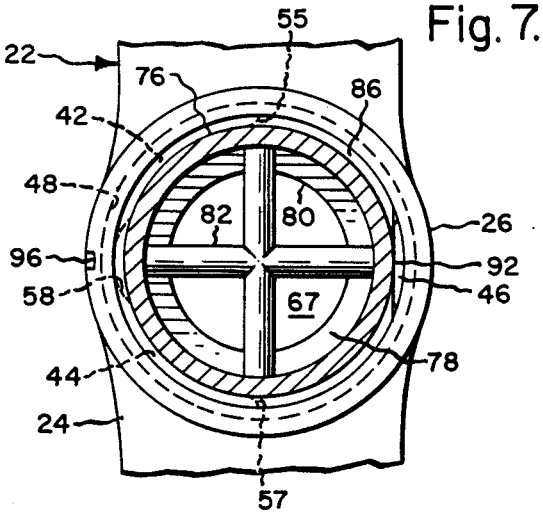
FIG. 7 is a cross-sectional view taken about on line 7—7 of FIG. 6.

With reference to FIGS. 6–9 and in accordance with the present invention, the retainer flange 86 and the turret section 26 are adapted to cooperate with one another to permit the retainer 34 to be inserted through the open end 36 of the turret section 26 and pressed or moved into snap-fit relationship with the turret section 26 as shown in FIG. 8. To this end and as shown in FIG. 7, the opening provided by the protuberances 42,44 and 46 is slightly smaller in size than the FIG. 7 projected area of the retainer end portion 68 and retainer flange 86 so that the retainer 34 must be forced in the direction of the arrow A (FIG. 6) relative to the turret section 26 to slidably move the retainer flange 86 through the aforedescribed opening by the retainer 42,44 and 46. Thus, the yieldability of the material comprising the turret section protuberances 42 and 44 and retainer flange 86 permit the retainer 34 to be forced or moved into snap-fit relationship with the turret section 26.

With reference again to FIG. 6, it will be understood that the distance as measured between the upper side as shown of the retainer flange 86 and the retainer end 74 is slightly less than the distance as measured between the underside, as shown, of the protuberances 42,44 and 46 and the side surface 64 of the turret section flange 50 so that the membrane 32 can be tightly held between the flange 50 and the retainer end 74 when the retainer 34 is operatively positioned within the turret section 26.

In order to assemble the instrument 20 and with reference still to FIG. 6, the membrane 32 is initially inserted through the open end 36 of the turret section 26 so that the membrane 69 overlies the side surface 64 of the turret section flange 50. The retainer end 74 is then inserted through the open end 36, and the retainer 34 is pressed relative to the turret section 26 in the direction of the arrow A (FIG. 6) to force the retainer flange 86 past the protuberances 42, 44 and 46 and into the annular groove 48. It will be understood that as the surfaces of the retainer flange 86 are forced against the surfaces of the protuberances 42 and 44, the protuberences 42 and 44 flex radially outwardly and the retainer flange 86 flexes radially inwardly to permit the retainer flange 86 to pass the common radial plane of the protuberances means 40. With the retainer flange 86 positioned within the groove 48 and the protuberances means 40 functioning in the manner of snap ribs, the retainer 34 is thereby positioned in snap-fit relationship with the turret section 26 as shown in FIG. 8 to snugly secure the membrane 32 within the turret 26 and strongly resist removal of the retainer 34 from the turret section 26. While the retainer end 74 presses the membrane frame 69 against the side surface 64 of the flange 50 when the retainer 34 is operatively positioned within the turret section 26 as aforedescribed, it will be understood that the opening 80 defined in the retainer flange 78 accommodates any vibrating action of the membrane material 67.

It will be understood that although FIGS. 6–7 illustrate such a relative orientation between the retainer 34 and the turret section 26 that the retainer flange cut-away 92 is generally aligned with the protuberance 46, the retainer 34 and turret section 26 can be operatively pressed into snap-fit relationship as aforesaid regardless of the relative orientation between the two.

Figure 10:
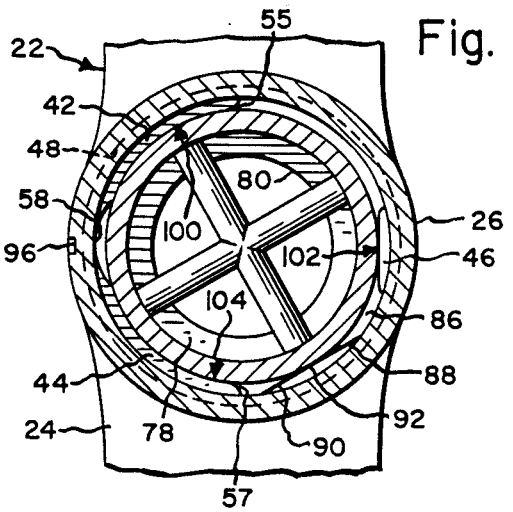
FIG. 10 is a view similar to that of FIG. 9 illustrating a relationship between the retainer and turret section after the retainer has been rotated relative to the turret section to an alternative rotational orientation to the rotational orientation illustrated in FIG. 9.

To lock the retainer 34 in the turret section 26 once the retainer 36 is positioned in the FIG. 8 snap-fit relationship and the cut-away 92 and protuberance 46 are generally aligned as shown in FIG. 8, the retainer 34 and turret section 26 are rotated relative to one another as the retainer flange 86 is slidably guided along the groove 48 to move the cut-away 92 and protuberances 46 out of alignment with one another. If, of course, the retainer 34 is initially pressed into snap-fit relationship with the turret section 26 so that the retainer flange cut-away 92 and protuberance 46 are not generally aligned, there is no need to rotate the retainer 34 and turret section 26 relative to one another. There is shown in FIG. 10 an exemplary relative rotational orientation between the retainer 34 and turret section 26 at which the cut-away 92 and protuberances 46 are out of alignment as with one another. In such an orientation and with reference to FIG. 10, the protuberances 42,44 and 46 engage the retainer flange 86 at three locations or points, indicated generally 100,102 and 104, which are circumferentially spaced about the outer surface 72 of the retainer end portion 68 and thereby effectively prevent removal of the retainer 34 from the turret section 26.

Figure 9:
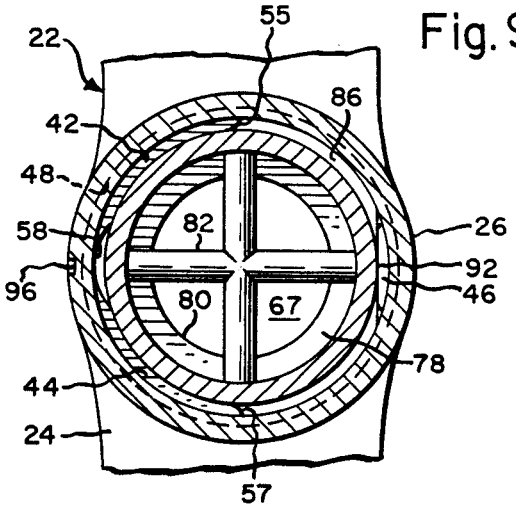
FIG. 9 is a cross-sectional view taken about on lines 9—9 of FIG. 8.
Figure 11:
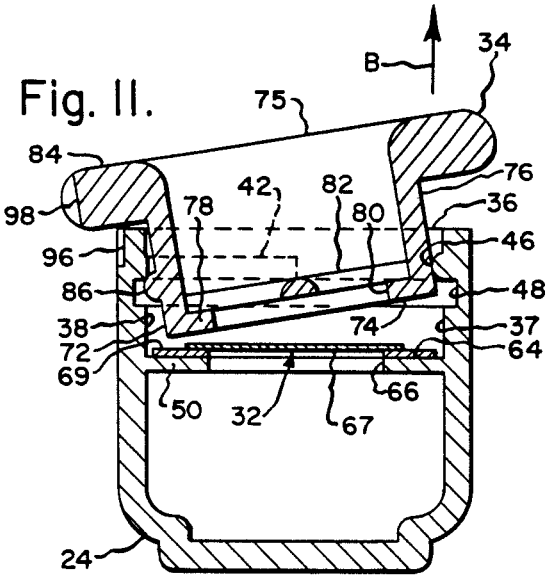
FIG. 11 is a view similar to that of FIGS. 6 and 8 illustrating a relationship between the retainer and the turret section during removal of the retainer from the turret section.

To remove the retainer 34 from the turret section 26 to provide access to the membrane 32 through the open end 26 and with reference to FIGS. 9 and 11, the retainer 34 is rotated relative to the turret section 26 to position or reposition, as the case may be, retainer flange cut-away 92 and protuberances 46 in alignment with one another as shown in FIG. 9. The section of the retainer flange 70 located in the vicinity of the retainer indentation 98 is then pryed or forced with the fingers relative to the turret section 26 in the direction of the arrow indicated B (FIG. 11). By forcing the flange 70 as aforesaid, the retainer flange cut-away 92 initially clears or passes the protuberances 46 and the retainer 34 moves to a canted orientation relative to the turret section 26. Additional and sufficient force applied in the direction of the arrow B of FIG. 11 forces the surfaces of the retainer flange 86 to slide or cam over the beveled ends 55 and 57 of the protuberances 42 and 44 and snap from beneath, as viewed in FIG. 11, the projections 42,46. It will be understood that the protuberances 42 and 44 and retainer flange 86 appropriately flex relative to one another to permit the retainer 34 to move out of snap-fit relationship as aforesaid. Once forced out of snap-fit relationship, the retainer 32,34 can be simply lifted out of the open end 36 to provide access to the membrane 32 such as may be desired for purposes of cleaning or replacing the membrane 32. It has been found that a relatively strong force is required to snap or force the retainer flange 86 from beneath the protuberances 42,44 as aforedescribed.

For visually and operatively aligning the retainer flange cut-away retainer flange cut-away 92 with the protuberance 46 in order to remove the retainer 34 from the turret section 26 and with reference to FIG. 6, the instrument 20 includes indicia means, generally indicated 94, in the form of an indentation 96 defined in the outer wall of turrent section 26 as shown and a corresponding indentation 98 defined in the retainer 34 as shown. The indentations 96 and 98 are generally positioned in alignment with one another along one side of the turret section 26 when the retainer 34 is positioned in a preselected rotational orientation relative to the turret section 26 so that cut-away 92 and protuberances 46 are positioned in alignment as aforesaid.

In view of the fact that the retainer flange cut-away 92 and turret section protuberances 46 must be initially aligned with one another as aforedescribed and the flange 70 pryed away from the open end 36 as aforedescribed with sufficient force to move the retainer 34 out of snap-fit relationship with the turret section 36, it will be understood from the foregoing that the retainer 34 and turret section 36 cannot be disassembled with relative ease. Thus, the aforedescribed cooperation between the turret section 26 and retainer 34 of the instrument 20 reduces any likelihood that a young child who may handle or play with the instrument 20 will remove the retainer 34 and harm himself with it.

It will be understood that many modifications and substitutions can be made to the aforedescribed instrument 20 without departing from the spirit of the invention. For example, although the retainer body cut-away 92 and protuberances 46 have each been shown and/or described as defining a relatively straight edge, the edges of the cut-away 92 and protuberances 46 can take any of a number of alternatives configurations so long as the protuberances 46 permits the cut-away 92 to pass during disassembly of the retainer and turret sections. Accordingly, the aforedescribed embodiment is intended for the purpose of illustration and not as limitation.

We claim:

1. A toy musical instrument comprising:

means defining a hollow, elongated tubular section through which air is directed when said instrument is operated and a hollow, generally cylindrically-shaped turret section having an open circular end and an inner surface extending from said open end so as to define an elongated interior cavity, said turret section being joined to said tubular section so that the hollow interior of said turret section and the hollow interior of said tubular section are in communication with one another and said open end opens to one side of said tubular section, said inner surface of said turret section including (a) means defining a plurality of radially inwardly-directed protuberances spaced from said open end and arranged in a common radial plane of said turret section, wherein one of said protuberances is in the form of radially inwardly-directed lug, (b) and a radially inwardly-directed annular turret flange spaced from said protuberances and positioned to one side thereof opposite said open end, means defining a resonating membrane operatively positioned within said turret section so as to span said turret flange, and means defining a retainer for releasably securing said membrane within said turret section, said retainer including an elongated, generally cylindrically-shaped body, having an outer surface and two opposite end portions, the first of said retainer end portions defining a generally radially outwardly-directed annular flange portion having rounded outer edges, and the second of said retainer end portions defining a circular membrane-facing end adapted to be inserted through the open end of said turret section wherein said outer surface extending from said membrane-facing end includes means defining a radially outwardly-directed flange, extending substantially around the retainer outer surface and terminating at two edges defining a cutaway of such shape and size that when said retainer and said turret section are positioned in a preselected rotational orientation to one another, said cutaway and said lug are aligned with one another along one side of the inner surface of the turret section and cooperate with one another to permit free movement of said lug through said cutaway when said retainer body is moved in either axial direction along said inner surface and wherein said outwardly-directed flange of said retainer and said protuberances are co-operable with one another to permit said outwardly-directed flange to snap over said protuberances when said membrane-facing end is inserted a predetermined distance through said open end so that said retainer body is secured in a snap-fit relationship with said turret section and said membrane is held between said membrane-facing end and said turret flange wherein said outwardly-directed flange of said retainer and said protuberances of said turret section are so shaped to permit said retainer and said turret section to disassemble from snap-fit relationship only if said retainer is positioned in said preselected rotational orientation relative to said turret section and wherein said outwardly-directed flange of said retainer and said protuberances of said turret section are so sized as to impede the disassembly of said retainer and said turret section when positioned in said preselected rotational orientation so as to prevent the easy disassembly from the snap-fit relationship by a child.

2. An instrument as defined in claim 1 wherein said outwardly-directed retainer flange and said protuberances are so shaped that when said retainer is positioned in the aforesaid snap-fit relationship and arranged relative to said turret section in a rotational orientation other than said preselected rotational orientation, said protuberances retainably engage said flange at three locations circumferentially spaced about said one end portion of said retainer body.

3. An instrument as defined in claim 2 wherein said protuberances include at least two arcuate protuberances which collectively extend around the inner surface of said turret section from a first point located on one side of said inner surface to a second point on said inner surface generally diametrically opposed to said first point.

4. An instrument as defined in claim 1 wherein said inner surface of said turret section further defines an annular groove positioned between said protuberance-defining means and said turret flange and adjacent said protuberance-defining means, and said annular groove is adapted to accept said outwardly-directed retainer flange when said retainer body is positioned in snap-fit relationship with said turret section.

5. An instrument as defined in claim 1 further comprising indicia means carried by said retainer and said turret section providing visual indication of a condition at which said retainer flange cutaway and said protuberance lug are generally aligned with one another.

6. An instrument as defined in claim 3 wherein the end portion of said retainer body opposite said one retainer end portion and said retainer body each define an exterior surface which can be viewed when said retainer body is positioned in the aforesaid snap-fit relationship, said indicia means includes a first indentation defined in the exterior surface of said retainer body and a second indentation defined in the exterior surface of said turret section and said first and second indentations are positioned in alignment with one another along one side of said turret section when said cutaway and said lug are aligned as aforesaid.

7. An instrument as defined in claim 1 wherein each of said turret section and said retainer body are comprised of a polypropylene plastic.

* * * * *